United States Patent [19]

Tanovici

[11] Patent Number: 4,878,631

[45] Date of Patent: Nov. 7, 1989

[54] ROLL HOLDER

[75] Inventor: Alexandru Tanovici, Arolsen, Fed. Rep. of Germany

[73] Assignee: HEWI Heinrich Wilke GmbH, Fed. Rep. of Germany

[21] Appl. No.: 240,840

[22] Filed: Sep. 2, 1988

[30] Foreign Application Priority Data

Sep. 4, 1987 [DE] Fed. Rep. of Germany ..... 3729559

[51] Int. Cl.[4] ..... B65H 75/32

[52] U.S. Cl. ..... 242/55.2; 242/68.5

[58] Field of Search ..... 242/55.2, 68.5

[56] References Cited

U.S. PATENT DOCUMENTS

| | | | |
|---|---|---|---|
| 1,674,285 | 6/1988 | Harvey | 242/55.2 |
| 2,073,429 | 3/1937 | Spicher | 242/55.2 |
| 2,419,798 | 4/1947 | Stone | 242/55.2 |
| 2,889,121 | 6/1959 | Heinle | 242/55.2 |
| 3,281,089 | 10/1966 | Krueger et al. | 242/55.53 |
| 3,292,874 | 12/1966 | Tinkham | 242/55.2 |
| 3,788,573 | 1/1974 | Thomson et al. | 242/55.2 |
| 4,783,016 | 11/1988 | Pool | 242/55.2 |

FOREIGN PATENT DOCUMENTS

| | | |
|---|---|---|
| 463665 | 7/1928 | Fed. Rep. of Germany . |
| 1289275 | 2/1969 | Fed. Rep. of Germany . |
| 2217616 | 10/1973 | Fed. Rep. of Germany . |
| 1294568 | 11/1972 | United Kingdom . |

*Primary Examiner*—David Werner

[57] ABSTRACT

The invention relates to a roll holder for a roll made from a web of material and having a hollow core, especially a paper roll provided with perforations running transversely. The roll holder contains a core body and a sleeve rotatably mounted thereon onto which the hollow core is mounted by its hollow core. To permit preselected sections of the material web to be torn off without the use of a flap bearing a tear-off edge or other aids, the sleeve is under the influence of a braking force which is applied by means provided on it and on the core body. The braking force is preferably adjustable.

11 Claims, 5 Drawing Sheets

ROLL HOLDERBACKGROUND OF THE INVENTION

The invention relates to a roll holder for a roll made from a web of material and having a hollow core, especially a paper roll provided with transversely running perforations, with a core body, at least one sleeve mounted on the latter and intended for insertion at least partially into the hollow core, and with a system for braking the roll when the web of material is pulled.

Roll holders of this kind are known (U.S. Pat. No. 4,660,781, German Fed. Pat. No. 463,665). They are characterized by the fact that the braking system has means for the braked mounting of the roll on the supporting element. These means consist, for example, of resiliently mounted brake disks laterally engaging the rolls, or of spring elements which are mounted radially on the supporting element and are biased against the roll, or against its core consisting of cardboard or the like, from the inside, i.e., from within the core tube. This results in the production of undefined braking forces, or braking forces which are dependent upon the outside and/or inside diameter of the roll, which differs from manufacturer to manufacturer.

In other roll holders (German Fed. OS No. 22 17 616, and AS No. 1,289,275, U.S. Pat. Nos. 774,937, 2,073,429, 2,467,825, 2,576,254 and 3,360,208, G.B. Pat. No. 1,294,568), in which braking forces are also produced when the material web is pulled, but which have no special braking system, the friction or braking forces present are, as a rule, very small. They do not suffice to permit the material web to separate along the perforation when jerked, or to prevent an undesirably long sections or sections of random length of the material web from becoming unwound on account of the continued spinning of the roll.

Similar conditions obtain in the case of known roll holders whose supporting elements have a pivoting flap with a tear-off edge which is disposed parallel to the perforations of the material web and rests on the circumference of the roll. In the case of such roll holders the problem is added that the material web is often torn such that the free end of the portion that is still on the roll comes to lie directly under the tear-off edge. It is then necessary to lift the flap with one hand and with the other hand pull the material web from under the flap.

On account of the above-described deficiencies of the known roll holders, the procedure of tearing off a preselected section of the material web, which in itself is quite simple, creates serious problems for certain persons, especially when they are ill, aged or handicapped with nervous disorders or poor powers of comprehension. In any case, roll holders with flaps are not always desirable, e.g., when they are offered as a component of a known set consisting of tubes, rods and/or nodes (German Fed. OS No. 26 32 696) and/or are to be integrated with a helper bar, handrail or the like composed of such elements.

The object of the invention is to construct the roll holder of the kind described above such that, even without using a flap bearing a tear-off edge, a perfect tearing off of the preselected sections of the material web will be possible, requiring no special skill therefor, and the roll holder can be configured in virtually any desired manner.

SUMMARY OF THE INVENTION

The distinctive features of claim 1 serve for the attainment of this object.

The invention offers the important advantage that, by applying a defined braking force to the rotatable core element, far better friction conditions can be created than can be when a random braking force is exerted on the roll itself. Furthermore, it is not necessary to make the core element rotatable or especially to arrange it so that the roll lies constantly against a wall or the like regardless of its diameter at any particular time, i.e., the roll can be situated anywhere in the space without the need to have both hands free for the controlled tearing off of preselected sections of the material. Lastly, the means provided for the braking of the core element can be substantially hidden and thus housed invisibly in the roll holder, which from the aesthetic point of view offers many advantages.

Other advantageous features of the invention are specified in the subordinate claims.

BRIEF DESCRIPTION OF THE DRAWINGS

The invention will be further explained below with the aid of embodiments in conjunction with the appended drawings, wherein.

DESCRIPTION OF PREFERRED EMBODIMENTS

Figure 1:
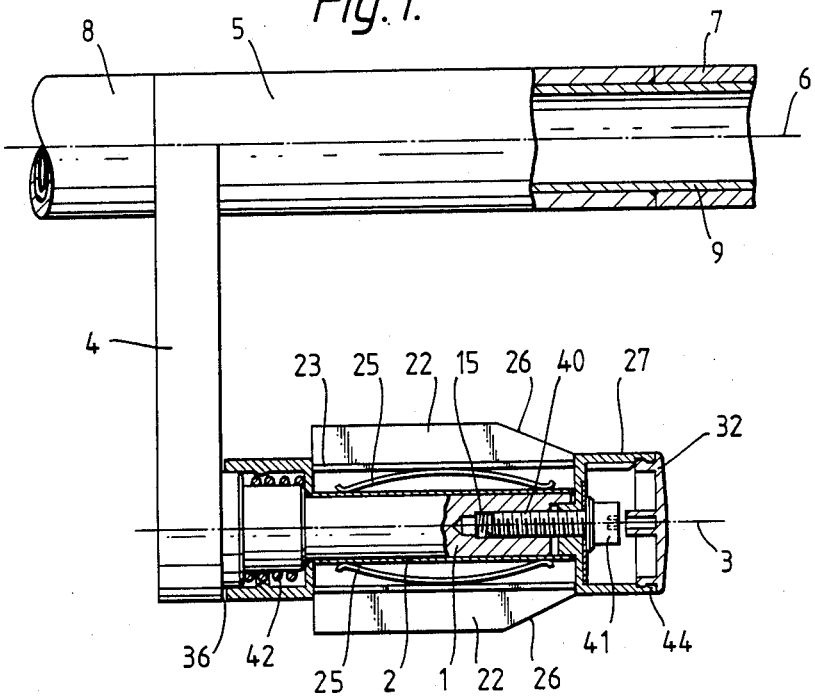
FIG. 1 is a front elevational view, partially in section, of the roll holder in accordance with the invention.
Figure 2:
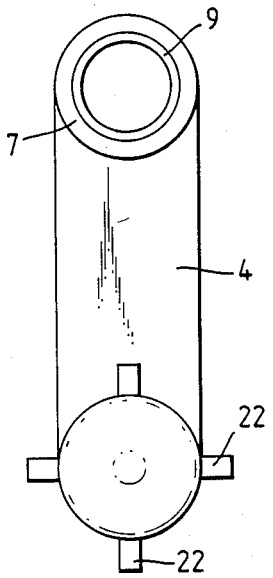
FIG. 2 is a side view of the roll holder of FIG. 1, FIGS. 3 and 4 are views corresponding to FIGS. 1 and 2 of a core body of the roll holder according to the invention.

According to FIGS. 1 and 2, the roll holder in accordance with the invention contains a core body 1 in the form of a stubshaft on which a sleeve 2 is rotatably mounted. The core body 1 is affixed to an arm 4 running at right angles to its axis 3, which in turn is affixed to one end of a tubular element 5 and perpendicular to its axis 6, so that the core body 1 and the tubular element 5 are parallel to one another.

The tubular element 5 has preferably the same outside cross section as the tube, rod and/or nodes of a known set for the assembly of grab rails, handrails or the like (DE-OS No. 26 32 696), so that it can be joined so as to be flush with, for example, a tubular element 7 or 8 of this set and then will be separated only by hairline seams from the latter. Through the junctions passes, for example, a tubular metal insert 9 inserted into the tubular elements 5, 7 and 8, with a matching outside diameter. The tubular element 5 can be held against rotation on the likewise unrotatably mounted metal insert 9 by providing the surface of the metal insert 9 with knurling.

Figure 3:
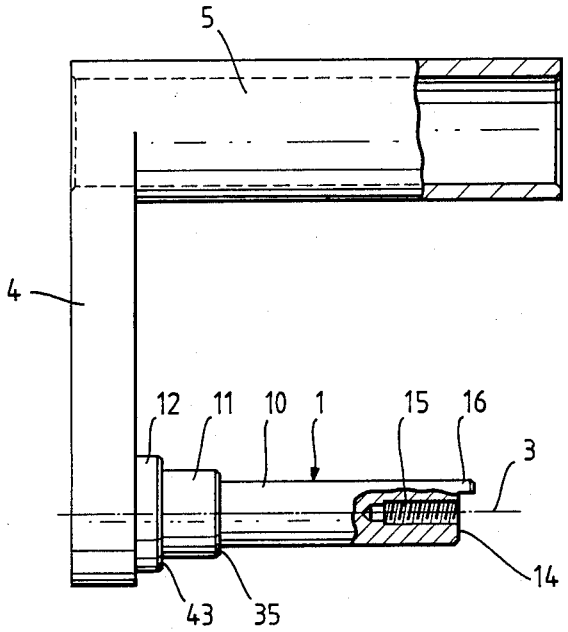
Figure 4:
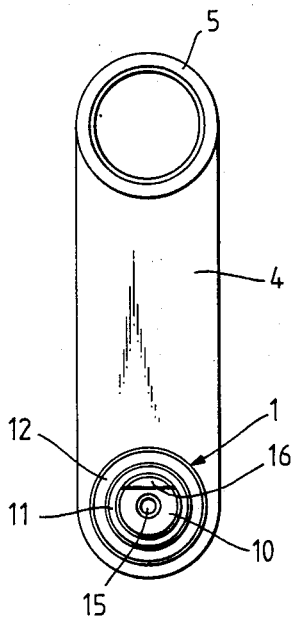

In FIGS. 3 and 4 the core body 1 has at its end remote from the arm 4 a cylindrical section 10 which merges step-wise at its end adjacent the arm 4 with a section 11 that is wider in cross section but coaxially disposed, and then passes through another step into a section 12 adjoining the arm and also coaxial with the axis 3, which is still wider in cross section than the section 11. In the end face 14 at the free end of the core body 1 there is formed a coaxial threaded bore 15. Also, a projection 16 extending beyond the end face 14 is provided at this end, whose cross section is configured in the manner of a segment of a circle, as shown especially in FIG. 4.

Figure 6:
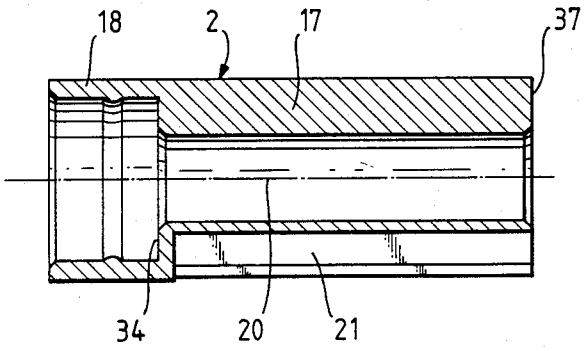
FIG. 6 is a section along line VI—VI of FIG. 5.

The sleeve 2 consists, as seen in FIG. 6, of a sleeve whose outside diameter corresponds preferably to the outside diameter of the tubular elements 5, 7 and 8. The inside diameter of the sleeve 2 corresponds in a section 17 substantially to the outside diameter of section 10 of the core body 1, while an adjoining section 18 of the sleeve 2 has an inside diameter that corresponds substantially to the outside diameter of section 12 of the core body 1.

Figure 5:
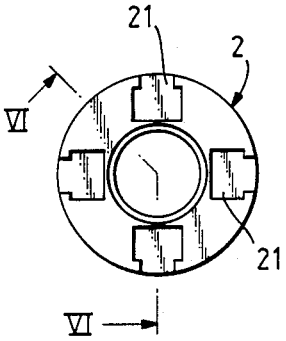
FIG. 5 is an enlarged side view of the sleeve of the roll holder of FIGS. 1 and 2.

In FIGS. 5 and 6, the sleeve 2 has at least one slot 21, preferably four slots 21, of T-shaped cross section, running parallel to its axis 20. These slots extend over the entire sleeve portion 17 and their narrower portions adjoin the outer circumferential surface of the sleeve 2.

Figure 7:
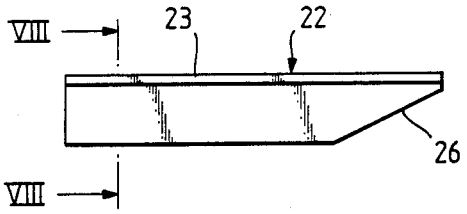
FIG. 7 is an enlarged front elevational view of one of the spines of the sleeve of FIGS. 5 and 6.
Figure 8:
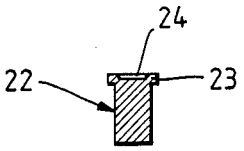
FIG. 8 is a section along line VIII—VIII of FIG. 7, FIG. 9 an enlarged top view of the core mandrel of FIG. 7, FIG. 10 an enlarged front elevation of a mounting part of the roll holder of FIGS. 1 and 2.
Figure 9:
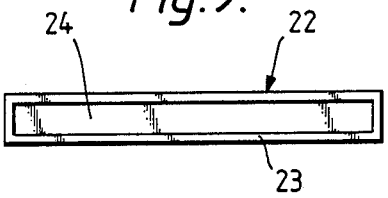
Figure 10:
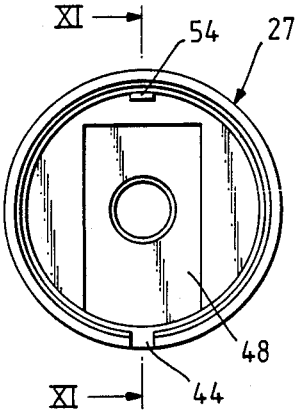
Figure 11:
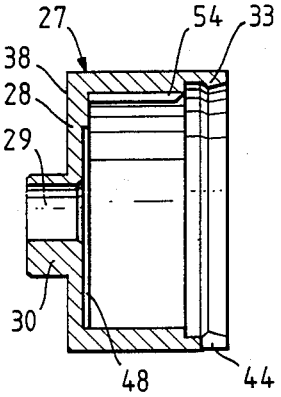
FIG. 11 is a section along line XI—XI of FIG. 10, FIGS. 12 and 13 are the back and bottom views, respectively, of the mounting part shown in FIG. 10.

The sleeve 2 in FIGS. 1 and 2 are provided lastly with at least one radially projecting spine which lays itself against the inside edge of a paper kitchen towel or toilet paper roll or the like when the sleeve 2 is at least partially inserted into its cylindrical core tube or the like, such that the roll is held with a friction fit and nonrotatably on the sleeve 2. In FIGS. 1 and 2, preferably several, and especially four such spines 22 are provided, which are distributed at equal angular intervals on the circumference of the sleeve 2. These spines 22 consist, in FIGS. 7 to 9, of resiliently mounted spreaders of substantially rectangular cross section. On one narrow side these spreaders have a wider portion 23 running their entire length resulting in an overall T-shaped cross sectional shape mating with the inside cross section of the slots 21. In each portion 23 there is also a rectangular recess 24. The spines 22 are, as seen in FIGS. 1 and 2, inserted into the T-slots of the sleeve 2 or slipped axially into them such that the portions 23 come to rest in the broader portions of the slots 21 while the portions of rectangular cross section project radially outwardly through the narrowed portions of the slots 21. Since the depth of the broader portions of the slots 21 is greater than the thickness of the portions 23, the latter can move up and down in the slots 21, so that the rectangular portions of the spines 22 project radially to a greater or lesser degree beyond the outer circumference of the sleeve 2. Between the recesses 24 and the bottom of the slots 21 lies a spring element 25, preferably a leaf spring (FIG. 2), so that the spines 22 are resiliently biased radially outwardly. At their ends adjacent the free end of sleeve portion 17 the spines 22 can each have a ramp 26 (FIGS. 1 and 7) terminating flush with the corresponding end of the sleeve 2, while their other ends, as seen in FIG. 1, abut against the abutments situated between the sleeve portions 17 and 18. The result is not only ease of manufacture and assembly, but also cleanliness since the seams between the sleeve 2 and the spines 22 can be kept very small. Moreover, the arrangement is made such that a great number of rolls of different core tube diameters can be held with a tight grip and therefore unrotatably on the sleeve 2 and the roll holder therefore is not limited to a particular type of roll.

The sleeve 2 is slipped over the core body 1, as shown in FIGS. 1 and 2, such that portion 17 comes to lie on section 10 and portion 18 partially on section 12. The cross sections are of such dimensions that a largely snug, sliding fit results and the sleeve 2 can be easily rotated on the core body 1.

Figure 12:
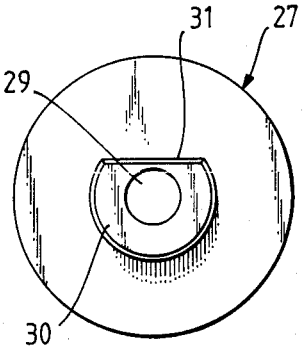
Figure 13:
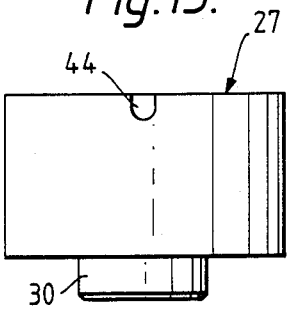

In accordance with the invention a system is furthermore provided for braking the roll as the material web is pulled from it. Since the roll itself is held against rotation on the sleeve 2, the brake system has cooperating means on the core body 1 and on the sleeve 2. Preferably the sleeve 2, when in use, is under the influence of an adjustable braking force. This purpose is served by a retaining means 27 represented in FIGS. 10 to 13, which consists essentially of a case with a cylindrical outer periphery corresponding in cross section to the outside cross section of the sleeve 2, the one end of the case having a bottom 28 with a central opening 29, so that, overall, a cup-like or cap-like shape results. The bottom 28 has a projection 30 at the back, through which the bore 29 passes; the projection is substantially cylindrical and has an outside diameter corresponding to the diameter of section 10 of the core body 1. This projection 30 is furthermore provided along a line 31 (FIG. 12) with a cutout of a shape precisely matching the projection 16. On its front inside circumference the retaining means 27 has a circumferential undercut 33 to produce a snap-in installation of an end cap 32 shown only in FIG. 1.

The assembly of the roll holder described above is performed as follows:

First the sleeve 2 with the spines 22 already inserted is placed on the core body 1 such that the front end of section 18 comes to rest on section 12 and a friction surface 34 at the transition between sections 17 and 18 engages a friction surface 35 (FIG. 3) at the transition between sections 10 and 11 of the core body 1. Section 18 is made so large in the axial direction that a small gap 36 (FIG. 1) remains between its free end and the arm 4. At the opposite end of the core body 1 its projection 16 is still disposed in the last end portion of section 17 of the sleeve 2.

Then the projection 30 is introduced into the free space remaining between the projection 16 and the sleeve 2 such that the projection 16 and the projection 30 combine along line 31 (FIG. 12) to form a cylinder with a diameter corresponding to the diameter of section 10 of the core body 1, as shown in FIG. 1, and thus simultaneously form an antirotational coupling to prevent rotation of the retaining means 27 about the axis 30 relative to core body 1. In this state the free face end of the sleeve 2 forms an additional friction surface 37 which is engaged by the friction surface 38 of the retaining means 27 surrounding the projection 30, while the free end of projection 16 does not come in contact with the friction surface 38 nor does the free end of the projection 30 come in contact with the free end face 14 (FIG. 3) of the core body 1. The retaining means 27 furthermore forms a prolongation of the sleeve 2 and its surface is flush with the surface of the latter.

Then an adjusting screw 40 is driven through the bore 29 of the retaining means 27 into the threaded bore 15. By this means on the one hand the sleeve 2 is fixed axially on the core body 1. On the other hand the head 41 of the adjusting screw 40 engages the margin of the bore 29, so that, when the adjusting screw 40 is further tightened the friction surfaces 34, 35 and 37, 38, are pressed against one another. Thus a definite braking force dependent upon the setting of the adjusting screw 40 is exerted on the sleeve 2. Since the projection 16 and projection 30 form an antirotational coupling, the retaining means 27 is unable to accompany the rotation of the sleeve 2, so that the braking force once selected remains independent of whether and how often the sleeve 2 is rotated. In order also to prevent the selected braking force from being subjected to great variations by changes in the friction force between the surfaces 34, 35 and 37, 38, respectively, due to temperature or moisture or the like, it is desirable to provide a strong compression spring 42, in accordance with FIG. 1, which thrusts between the friction surface 34 and an additional friction surface 43 which is formed by the difference in diameter between sections 11 and 12 of the core body 1 (FIG. 3), such that only the friction surfaces 37 and 38 will remain in contact, while the sleeve 2 is under the influence of the compression spring 42 at the other end.

After the cap 32 has been snapped onto the retaining means 27 the roll holder is ready for operation. A roll, which is not shown, is pushed from the cap 32 side onto the retaining means 27 and the sleeve 2, while the spines 22 are displaced more or less strongly, but resiliently, into the slots 21 of the sleeve 2, so that they will always thrust firmly against the core tube despite variations or diameter differences, and hold the roll against rotation on the sleeve 2. Therefore, if the material web wound on the roll is pulled off, the roll will always rotate only in accordance with the preselected braking force exerted on the sleeve 2. If a section of the material web is to be torn off along a perforation or the like, all that is needed is an abrupt pull on this section, without the need to hold the roll or the sleeve 2 with the hand.

The controllability of the braking force permits adaptation to different types of paper and can always be preselected by adjusting the screw 40 such that the material web can be pulled off slowly without tearing, and that by exerting a certain tearing force a preselected section can be separated. Therefore especially the handicapped with nervous ailments or poor comprehension can always grasp the free end of the material web and, if necessary, tear off a new section of the material.

When the cover 32 (FIG. 1) is used, it is preferable that only a hairline seam remain visible between it and the retaining means 27. In order nevertheless to be able to remove the cap 32 if necessary, for the purpose of varying the braking force for example, the retaining means 27 is provided on the side with a gap 44 (FIGS. 1, 10, 11, 13) into which a tool can be introduced in order to pry off the cap 32 from the retaining means 27.

Figure 14:
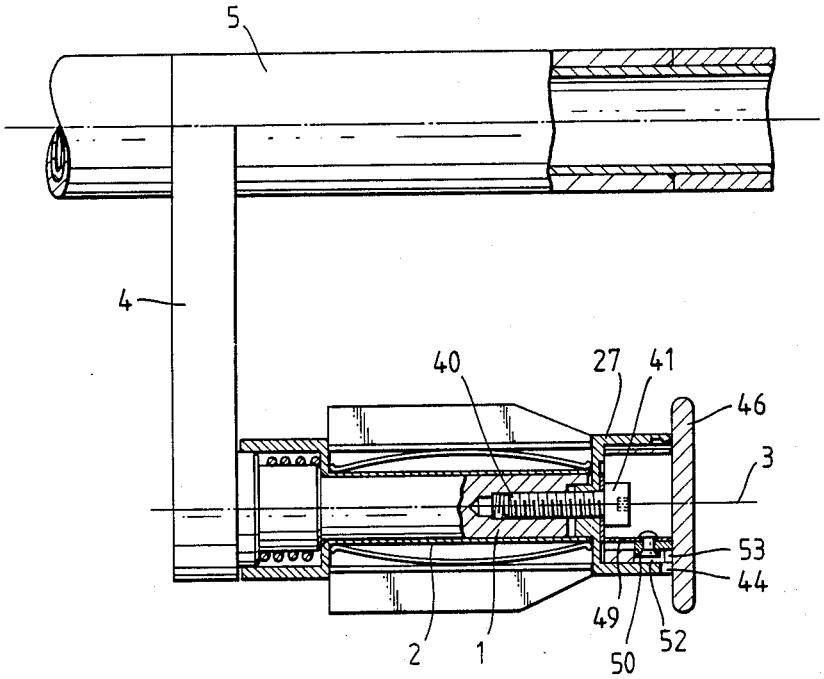
FIG. 14 is a view corresponding to FIG. 1 of a second embodiment of the roll holder of the invention.
Figure 15:
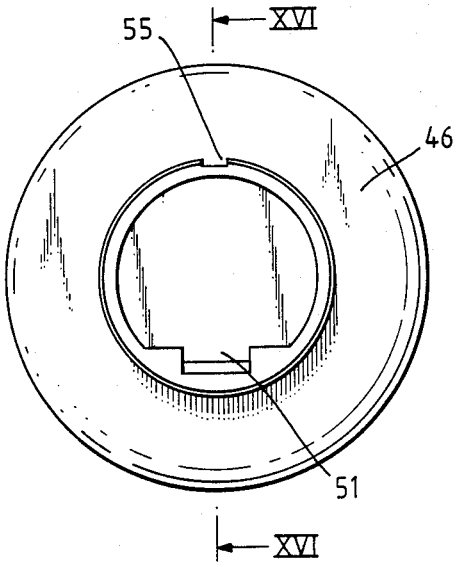
FIG. 15 is an enlarged rear view of a cover disk of the roll holder of FIG. 14, FIGS. 16 and 17 are sections along lines XVI—XVI of FIG. 15 and XVII—XVII of FIG. 16, respectively.
Figure 16:
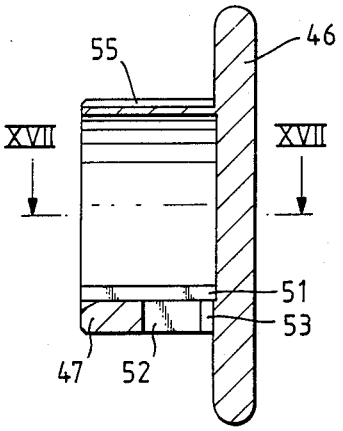
Figure 17:
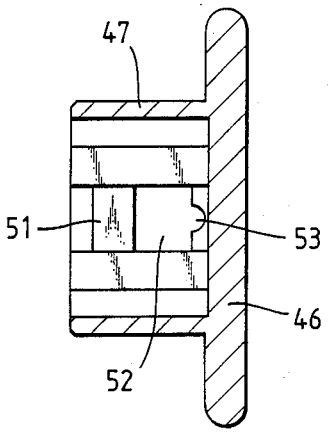

When the roll holder is used in public buildings, such as hospitals, schools or the like, it is often undesirable for the cap 32 to be easily removable. It would therefore be possible to omit the gap 44 from the retaining means 27 and instead to provide the cap 32 with a small central hole through which authorized persons can introduce a small screwdriver or Allen wrench and thus operate the adjusting screw even without removing the cap 32. Also conceivable would be a configuration of the cap 32 such that, when it is turned the adjusting screw 40 would also be turned, without, however, causing the cap 32 to be removed from the retaining means 27. But it is especially advantageous to provide a cap 46, which is represented in FIGS. 14 to 17. In that case the embodiment seen in FIG. 14 is identical with the embodiment in FIG. 1, except for the different cap 46.

On the back of the cap 46 is a collar-like projection 47 which fits precisely into the cylindrical retaining means 27. In the bottom 28 of the latter there is provided a rectangular recess 48 (FIGS. 10, 11) in which the one limb of an angle bracket 49 (FIG. 14) made of resilient material is disposed. The fastening is performed by means of the adjusting screw 40 passing through a hole in this limb. The other limb of the bracket 49, at 90° from the first, runs parallel to the axis 3 into the collar 47 and is provided at its free end with a catch 50. The collar 47 has on its interior a groove 51 running parallel to its axis, in the bottom of which is an opening 52 corresponding in size to the cross section of the catch 50, which is prolonged by a semicircular section 53 of very small radius (e.g., no more than 1 mm) closely adjoining the cap 46. The arrangement is made such that the catch 50 will snap into the opening 52 when the collar 47 is pressed into the retaining means 27, thus axially locking the cap 46 to the retaining means 27, leaving no fastening means visible from the exterior. At the same time, however, the gap 44 (FIG. 1) is opposite the semicircular section 53, so that a hole scarcely visible from the exterior is present through which the authorized persons, who know the mechanism, can act with a steel pin or the like on a prolongation of the catch hook 50 and thereby force the latter out of the opening 52 when the cap 46 is to be removed. This results in an effective safeguard against unauthorized removal or turning of the adjusting screw, since the gap 44 and section 53 can be made very small.

Lastly, in contrast to the cap 32 (FIG. 1), the cap 46 has preferably a diameter that is greater than the inside diameter of the core tube of the rolls to be installed on the roll holder. This results in a useful safeguard against unauthorized removal of the entire roll, since it cannot be removed after the cap 46 has been snapped into the retaining means 27.

If it is desired to render the hole provided for releasing the catch 50 entirely invisible, it can also be located at a point which is concealed by the roll and its core tube after the roll has been mounted on the retaining means 27 and the sleeve 2. For this purpose the sum of the axial lengths of the sleeve 2 and of the retaining means 27 can be made to correspond to the conventional axial length of the rolls. In this case the cap 46 cannot be removed again from the retaining means 27 even by authorized persons until after the roll has been completely used up and, if desired, after the destruction of its core tube.

To enable the catch hook 50 to snap into the opening 52 with certainty when the cap 46 is placed on the retaining means 27, guides are preferably provided which enable it to be installed only with a certain relative angular orientation. These guides consist, for example, of a projecting key 54 (FIGS. 10 and 11) on the inside of the retaining means 27, and a groove 55 for receiving it (FIGS. 15 and 16) on the outer periphery of the collar 47 of the cap 46. As seen especially in FIGS. 10 to 13, the retaining means 27 can always be made the same regardless of which cap, 32 or 46, is to be combined with it.

The invention is not limited to the embodiments described, which can be modified in many ways. It is possible, for example, to omit the retaining means 27 and have the head 41 of the adjusting screw 40 engage the outer end face of the sleeve 2. To prevent removal of the adjusting screw 40 in this embodiment too, the friction surfaces in engagement between the sleeve 2 and the head 41 can be made so small that it will be impossible for the adjusting screw 40 to be turned by the sleeve 2 when the latter is rotated. Furthermore a comparatively long adjusting screw 40 can be used, and at least section 10 of the core body 1 can be made of plastic so as to provide self-locking in the threaded sections and large friction surfaces preventing co-rotation of the adjusting screw 40. If it is not desired to integrate the roll holder into a combination consisting of tubes, rods and/or node elements, the core body 1 can be fastened also to any other mounting bodies and can be mounted together with them directly on a wall or the like, and it is possible to dispose the core body 1 perpendicular to the wall or the like. Lastly, it is possible to provide other spines 22 or a more or less than four such spines 22 for holding the roll nonrotatably on the sleeve 2, to make core body 1 and sleeved 2 of a different form, and/or to provide other systems for controlling the braking force acting on the sleeve 2.

The core body 1, the arm 4, and the tubular element 5 are preferably made of plastic and injection molded in one piece. The sleeve 2, clutch jaws 22, the retaining means 27 and the caps 32 and 46 consist preferably also of injection-molded plastic.

Figure 18:
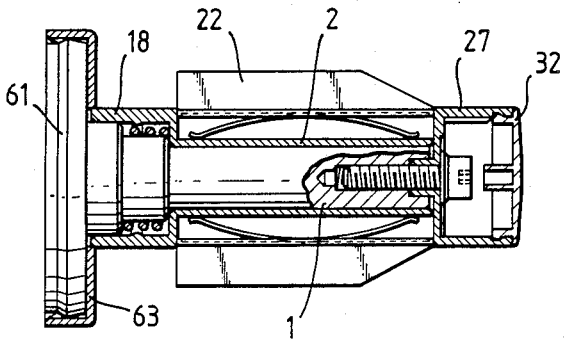
FIG. 18 is a view corresponding to FIG. 1 of a third embodiment of the roll holder of the invention.
Figure 19:
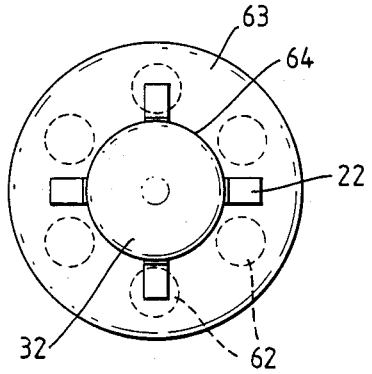
FIG. 19 is a front elevation of the embodiment in FIG. 18.

An additional of the roll holder in accordance with the invention is to be seen in FIGS. 18 and 19, wherein the same reference numbers are used for the same parts. In comparison to FIGS. 1 and 14, the core body 1 is not fastened to the arm 4 by the arm to the tubular element 5, but to a base 61 consisting for example, of steel or plastic, which is provided with several holes 62 indicated in FIG. 19 to accommodate mounting screws. The base 61 consists of a flat substantially plane-parallel disk which is fastened to a wall or the like and is joined to the core body 1 such that the latter projects substantially perpendicularly from the wall or the like after the base 61 has been fastened to the latter. The base 61 is covered by a cap 63 which has about the same external cross section as the base 61 and can be joined to the latter by undercuts or the like formed on the circumference. The cap 63 has a central opening 64 (FIG. 19) whose cross section corresponds substantially to the cross section of section 18 of the sleeve 2 and accommodates the end of the latter that is remote from the retaining means 27. In the assembly of the embodiment in accordance with FIGS. 18 and 19, it is desirable first to fasten the base 61 to the wall or the like, then draw the cap 63 over the core body 1 and then place the sleeve 2 on the core body 1 and introduce it into the opening 64.

I claim:

1. Roll holder for a roll which is made from a material web and has a receiving opening, especially a paper roll provided with perforations running transversely, comprising: a bearing body having a friction surface formed thereon, a shaft with a free face end and an adjusting screw driven into said free face end, said screw having a head; a carrier element containing a tube rotatably mounted on said shaft, serving for at least partial insertion into the receiving opening and being clamped axially between said friction surface and said head; a compression spring held between said friction surface of the bearing body and an associated friction surface of said carrier element; means mounted on said carrier element whereby said roll is held unrotatably on said carrier element; and braking means mounted on the bearing body and on the carrier element for producing a defined braking force when said carrier element rotates on said bearing body, said braking means containing said adjusting screw for regulating said braking force.

2. Roll holder in accordance with claim 1, characterized in that, between the head of the adjusting screw and the carrier element, a retaining means joined fixedly to the bearing body is disposed, which has a friction surface cooperating with an additional friction surface of the carrier element and a through opening for the adjusting screw.

3. Roll holder for a roll which is made from a material web and has a receiving opening, especially a paper roll provided with perforations running transversely, comprising: a bearing body having a friction surface formed thereon, a shaft with a free face end and an adjusting screw driven into said free face end, said screw having a head; a carrier element containing a tube rotatably mounted on said shaft, serving for at least partial insertion into the receiving opening and being clamped axially between said friction surface and said head; means mounted on said carrier element whereby said roll is held unrotatably on said carrier element; braking means mounted on the bearing body and on the carrier element for producing a defined braking force when said carrier element rotates on said bearing body, said braking means containing said adjusting screw for regulating said braking force, and a retaining means disposed between the head of the adjusting screw and the carrier element and being unrotatably coupled to said bearing body, said retaining means having a friction surface cooperating with an additional friction surface of said carrier element and a through opening for said adjusting screw.

4. Roll holder in accordance with claim 3, characterized in that the carrier element is provided with at least one radially projecting spine intended for pressing against the inner wall of the receiving opening.

5. Roll holder in accordance with claim 4, characterized in that the spine consists of a spreader that is under spring bias.

6. Roll holder in accordance with claim 5, characterized in that the carrier element has a cylindrical outer periphery in which at least one axially parallel slot receiving the spine is configured with a bottom, and that between the bottom of the slot and the spine a spring biasing the latter radially outwardly is disposed.

7. Roll holder in accordance with claim 3, characterized in that a compression spring is held between the friction surface of the bearing body and an associated friction surface of the carrier element.

8. Roll holder in accordance with claim 3, characterized in that the retaining means consists of a cap with an outwardly open side and a bottom, the through opening is formed in the bottom of the cap, and the open side of the cap is closable with a removable cover disk.

9. Roll holder in accordance with claim 8, characterized in that the cover disk can be locked to the fastening part by a catch concealed in the cap.

10. Roll holder in accordance with claim 9, characterized in that the catch is accessible through an opening in the retaining means.

11. Roll holder in accordance with claim 9, characterized in that the catch is accessible through a hole in the carrier element.

* * * * *